US006461744B1

(12) United States Patent
Giunchi et al.

(10) Patent No.: US 6,461,744 B1
(45) Date of Patent: Oct. 8, 2002

(54) ARTICLE BASED ON A METAL ALLOY OF NICKEL, CHROMIUM AND METALLOID ELEMENTS INCLUDING MICROCRYSTALLINE PRECIPITATES, METAL ALLOY AND PREPARATION METHOD

(75) Inventors: Giovanni Giunchi, Novara; Sergio Ceresara, Lucca, both of (IT)

(73) Assignee: Edison Termoelettrica S.p.A., Milan (IT)

( * ) Notice: Subject to any disclaimer, the term of this patent is extended or adjusted under 35 U.S.C. 154(b) by 27 days.

(21) Appl. No.: 09/736,142

(22) Filed: Dec. 15, 2000

(30) Foreign Application Priority Data

Dec. 17, 1999 (IT) ..... MI99A2629

(51) Int. Cl.[7] ..... B21C 37/00; C22C 19/05; C22F 1/10

(52) U.S. Cl. ..... 428/606; 148/403; 148/427; 148/538; 148/555; 148/675; 420/422; 420/580; 420/588

(58) Field of Search ..... 428/606; 420/442, 420/580, 588; 148/403, 427, 538, 555, 675

(56) References Cited

U.S. PATENT DOCUMENTS

| | | | | |
|---|---|---|---|---|
| 4,510,183 A | | 4/1985 | Akyol | 427/436 |
| 4,543,135 A | * | 9/1985 | Bose et al. | 428/606 |
| 4,658,537 A | | 4/1987 | Bose et al. | 228/263.15 |
| 4,712,603 A | | 12/1987 | Bose et al. | 164/463 |

FOREIGN PATENT DOCUMENTS

| | | |
|---|---|---|
| EP | 0 826 758 | 3/1998 |
| EP | 0 847 826 | 6/1998 |
| FR | 1 153 795 | 3/1958 |
| WO | WO 96/37335 | 11/1996 |
| WO | WO 97/43082 | 11/1997 |

OTHER PUBLICATIONS

Japan Abstract, vol. 1999, No. 05, May 31, 1999, JP 11 047980, Feb. 23, 1999.

Japan Abstract. vol. 1995, No. 10, Nov. 30, 1995, JP 07 180039, Jul. 18, 1995.

Japan Abstract, vol. 1996, No. 05, May 31, 1996, JP 08 013135, Jan. 16, 1996.

Japan Abstract, vol. 1995, No. 10, Nov. 30, 1995, JP 07 173611, Jul. 11, 1995.

Japan Abstract, vol. 1995, No. 07, Aug. 31, 1995, JP 07 102361, Apr. 18, 1995.

* cited by examiner

*Primary Examiner*—Robert R. Koehler
(74) *Attorney, Agent, or Firm*—Oblon, Spivak, McClelland, Maier & Neustadt, P.C.

(57) ABSTRACT

A description follows of an article based on a nickel-chromium-silicon metal alloy, including microcrystalline borides, obtained by the rapid solidification and subsequent thermal treatment of a nickel-chromium-boron-silicon metal alloy comprising from 39.0 to 69.4 atom % of nickel, from 11.8 to 33.9 atom % of chromium, from 7.6 to 27.4 atom % of boron and from 7.6 to 17.5 atom % of silicon. The above article is preferably a tape or a sheet or a fiber having high mechanical properties and is particularly resistant to oxidation.

12 Claims, 6 Drawing Sheets

ARTICLE BASED ON A METAL ALLOY OF NICKEL, CHROMIUM AND METALLOID ELEMENTS INCLUDING MICROCRYSTALLINE PRECIPITATES, METAL ALLOY AND PREPARATION METHOD

The present invention relates to an article based on a metal alloy of nickel, chromium and metalloid elements including microcrystalline precipitates, and the relative preparation method.

It is known in the art that metal superalloys based on nickel allow performances characterized by an extremely high mechanical resistance at high temperatures; in fact, alloys based on nickel-chromium, for example, are used for the construction of blades in gas turbine rotors. The use of this group of alloys in resistors is also known, owing to the high resistivity with respect to conventional metal conductors, the low variation resistivity coefficient with temperature and the above-mentioned mechanical resistance at high temperature.

Furthermore, some particular compositions of these alloys (with respect to the Ni/Cr ratio) are used in the electro-technical field owing to their reduced or absence of magnetic susceptibility.

It is also known that the melting point of these alloys can be lowered by several hundreds of degrees, by adding metalloid elements such as phosphorous, boron or silicon. The alloys thus obtained are particularly suitable for the brazing of steel or other superalloys based on nickel, in particular in the form of fine sheets having a thickness of less than 50 $\mu$m, which are prepared by means of the rapid solidification technology, for example on a cooled rotating wheel (melt spinning or planar flow casting) (U.S. Pat. No. 4,148,973).

The presence of metalloids in the alloy and the high solidification rate cause the amorphization of the tapes or sheet thus produced, which have particularly high mechanical properties only below the crystallization temperature i.e. typically below 300–400° C. Over these temperatures the end-products thus obtained become fragile and it is therefore not possible to use them in applications which require a structural resistance at high temperatures.

This problem is known in particular and the state of the art (Tung S. K. et al., Scripta Materialia, 345, 1996) indicates that this fragility of superalloys containing metalloids, is due to the formation of intermetallic compounds which are formed in the above alloys. Efforts have consequently been made to solve this problem by introducing the minimum possible quantity of said metalloids, i.e. the absolute quantity necessary for amorphization. From what is specified above, it is evident that the use of superalloys in films or fine sheets, having a thickness of less than 50 $\mu$m, is extremely limited owing to the problems described above.

The present invention therefore proposes to overcome the drawbacks present in the known art.

It has been surprisingly found, in fact, that by using alloys based on nickel-chromium, with a low or no magnetic susceptibility (i.e. with a higher chromium content), containing metalloid elements, such as boron and silicon, in a higher quantity with respect to what is described in the known art, and by subjecting the above alloys to a particular thermal treatment after rapid solidification it is possible to produce tapes or filiform end-articles having interesting mechanical properties and resistance to oxidation, without the fragility typical of materials having a similar composition crystallized at temperatures only slightly higher than the glass transition temperature.

An object of the present invention therefore relates to an article based on a nickel-chromium-silicon metal alloy, including microcrystalline borides, obtained by the rapid solidification and subsequent thermal treatment , at a temperature ranging from 700° C. to 950° C. for a time which varies from 5 minutes, in the upper temperature limit, to 100 hours in the lower temperature limit, of a nickel-chromium-boron-silicon metal alloy comprising from 39.0 to 69.4 atom % of nickel, from 11.8 to 33.9 atom % of chromium, from 7.6 to 27.4 atom % of boron and from 7.6 to 17.5 atom % of silicon.

The thermal treatment is carried out within the range of 700 to 950° C., bearing in mind that below the lower temperature limit, the duration times are very long, over hundreds of hours and therefore of limited industrial interest, whereas over the upper temperature limit, coalescence phenomena of the precipitates arise, which reduce the mechanical properties. In the intermediate temperature range the treatment has an adequate duration, in the order of hours, with longer times at low temperatures and shorter times at high temperatures.

A further object of the present invention relates to a tape-form or filiform article having a thickness of less than 50 $\mu$m.

An additional object of the present invention relates to the use of articles in the form of non-magnetic tapes as substrates for the growth of superconductor oxides.

An object of the present invention also relates to the use of articles in tape, sheet or fiber form as a reinforcing element in composite materials with an organic, metallic or pyroceram matrix.

In particular, the tape-form or filiform article according to the present invention is characterized in that it has a thickness ranging from 5 to 40 $\mu$m.

The thermal treatment according to the present invention is preferably carried out in an inert gas or under vacuum, at a temperature preferably ranging from 750° C. to 880° C. and for a time which varies from about 30 minutes (at the upper limit of the temperature range) to about 15 hours (at the lower limit of the temperature range).

The very particular properties of the article according to the present invention are obtained as a result of the rapid solidification and subsequent thermal treatment to which the article is subjected.

This treatment, in fact, allows a structure to be obtained, which is characterized by the presence of microcrystals of nickel and chromium borides, precipitated in the metallic matrix of the nickel, chromium and silicon constituents. If the thermal treatment is carried out in air, the article, on oxidizing, has a nickel, chromium and silicon elemental composition of the matrix, which varies in the different parts of the article itself.

In particular, the use of articles in non-magnetic tape form as substrates for the growth of superconductor oxides, is especially interesting.

The possibility of obtaining superconductor tapes by deposition, with physical or chemical methods, of superconductor oxides on metallic substrates, is known, but the use of this metallic substrate has various problems.

The metallic substrate, in fact, must not only be non-magnetic (a necessary quality for guaranteeing low stream and/or varying magnetic field losses, in regime), but must also be extremely fine (a few tens of micrometers at the most), in order to obtain a high volumetric ratio between the fine superconductor film (in the order of micrometers) and the metallic substrate. In addition, the metallic substrate should not be reactive with the superconductor oxide at the high temperatures typical of its crystalline growth, i.e. at temperatures ranging from 800° C. to 900° C. In order to satisfy all the above conditions, the metallic substrates are generally produced by means of laborious rolling techniques and sophisticated deposition technologies of protective films, as regards both the oxidation of the substrate, and also with respect to the migration of metallic elements from the substrate to the superconductor oxide.

This use of the article according to the present invention is particularly advantageous in that the substrate in tape-form, which can be produced with the rapid solidification technique (by means of planar flow casting), can be obtained with a high productivity and with a particularly fine thickness. Furthermore, after the thermal treatment according to the present invention, it has high mechanical resistance properties and a limited reactivity under oxidative conditions, at the typical temperatures ranging from 800° C. to 900° C., at which the substrate must be maintained in the growth process of superconductor oxides.

In particular, an object of the present invention relates to the use of the end-articles in tape, sheet or fiber form as a reinforcing element in composite materials with an organic, metallic or pyroceram matrix, having an assembly temperature lower than or equal to 900° C.

A detailed and illustrative description is provided below for a better understanding of the characteristics and advantages of the product and process according to the present invention.

The metal alloy consisting of nickel, chromium and metalloid elements, i.e. the quaternary alloy according to the present invention, comprises the following composition:

Ni—Cr: (a total of 65 atom % to 84.5 atom %) with an atomic ratio between the metals Ni/Cr ranging from 1.5 to 4.5;

B—Si: (a total of 15.2 atom % to 35 atom %) with Si≧7.6 atom % and B≧Si.

The metal alloy consists of nickel, chromium and metalloid elements, i.e. the quaternary alloy according to the present invention, can therefore also be represented by the following general formula:

$$Ni_xCr_yB_wSi_z$$

wherein $x+y+w+z=100$; $x+y=65–84.8$;

$x/y=1.5–4.5$; $w/z>1$; $7.6<w<27.4$.

The composition ranges are those indicated above and specifically:

Ni: 39.0–69.4 atom %;

Cr: 11.8–33.9 atom %;

B: 7.6–27.4 atom %;

Si: 7.6–17.5 atom %.

Accidental uneliminable impurities can be tolerated but less than 0.1% by weight.

The alloy of the composition according to the present invention can be obtained by means of the usual melting methods of the constituent elements or their partial alloys, and subsequent cooling, in an inert atmosphere, i.e. without gases such as oxygen or nitrogen which are reactive with respect to metals, or under vacuum.

End-articles can subsequently be prepared starting from this alloy, in the desired form, tape, film, sheet, fiber, having a thickness of less than 50 $\mu$m and with a high productivity, in practically amorphous phase, preferably using the forming technology based on rapid solidification (for example melt spinning and planar flow casting).

These products must then be treated according to the particular thermal process, object of the present invention, to overcome their high fragility which occurs when the crystallization of the amorphous phase takes place at temperatures slightly higher than the glass transition temperature.

They are then subjected to thermal treatment which, in a particular application, can be carried out in an atmosphere of an inert gas or under vacuum at a temperature preferably ranging from 750° C. to 880° C., for a time varying from about 30 minutes (at the upper limit of the temperature range) to about 15 hours (at the lower limit of the temperature range).

If the treatment is carried out under vacuum, it preferably takes place at a pressure lower than $10^{-4}$ mbars. If it is carried out in an inert gas, for example He or Ar, it can be effected at any pressure.

Following this treatment, the material is completely crystalline and is composed of a metallic-type matrix, prevalently made up of a solid solution, crystallized in the face-centered cubic system (FCC), and precipitates of microcrystalline nickel and chromium borides ($Ni_3B$ and CrB), as can be observed from X-ray diffraction analysis of the product. In the X-ray diffraction diagram the reflexes corresponding to the silicide phases are not clear and this leads to the conclusion that the specific characteristic of the metallic matrix having an FCC structure is that it is composed of an essentially ternary alloy based on Ni, Cr and Si.

The end-article thus obtained has high values relating to hardness, tensile modulus, yield point and ultimate tensile strength, together with a good ductility, even after being subjected to subsequent and repeated thermal treatment.

Vickers hardness values typical of the article obtained are 450 HV, typical ultimate tensile strength values are 1100 MPa, typical tensile modulus values are 170 GPa and the ductility is such that there is no breakage even when the bend radius is in the order of the tape thickness.

Furthermore, the end-article thus obtained is exceptionally resistant to oxidation up to high temperatures, in fact, if treated in air at 850° C. for 1 hour its weight percentage increases by 0.14%, whereas a tape having an analogous thickness of a conventional alloy with a low oxidability, Nichrome 80/20, treated under the same condition, undergoes a weight percentage increase of 0.27%.

The main advantage of the article according to the present invention lies, as previously observed, in the combination of a low oxidability with high mechanical properties even at temperatures of about 600° C.

The following examples provide a better illustration of the present invention.

EXAMPLE 1

250.8 g of electrolytic Ni having a purity>99.9% (65.07 atom %), 51.28 g of Cr having a purity>99.9% (15.02 atom %), 14.8 g of Si having a purity>99.9% (8.03 atom %) and 8.53 g of B having a purity>99.9% (12.02 atom %), were melted in a plasma oven in an atmosphere of helium. The alloy was then re-melted to guarantee its homogeneity.

Figure 1:
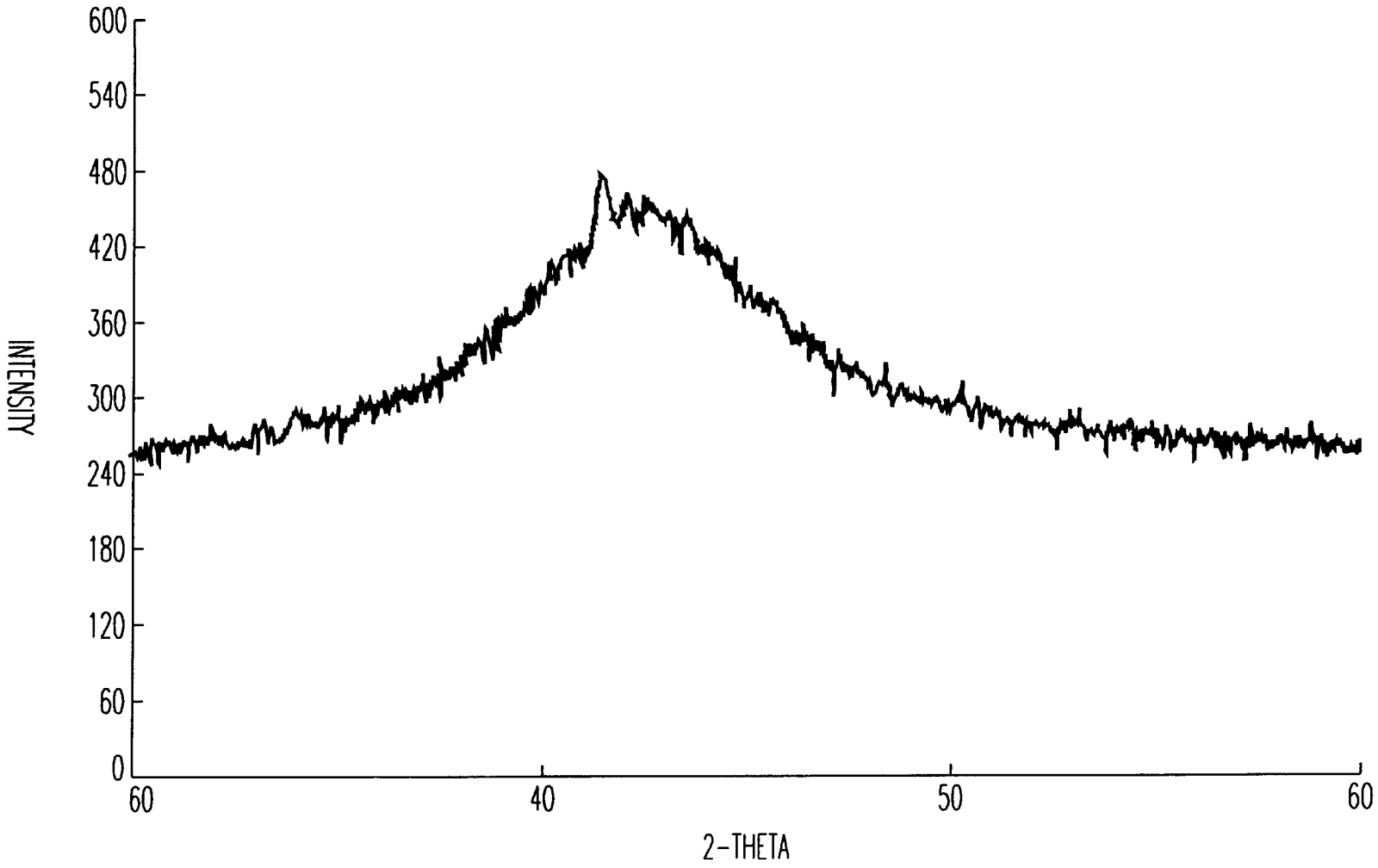
FIG. 1 is an x-ray diffraction graph for the tape of Example 1.

The button thus obtained was used to produce a tape having a width of 10 mm and a thickness of 30 $\mu$m, using the rapid solidification technique by casting on a rotating wheel at a tip speed of 30 m/s. The resulting tape (defined hereinafter as product 1.a) has a surface roughness, on the opposite side to that in contact with the wheel, having a thickness of less than 30 nm. The tape thus obtained has a substantially amorphous structure, as indicated by X-ray diffraction, illustrated in FIG. 1. This X-ray diffraction shows a wide-spread halo having its maximum intensity at the diffraction angle $2\theta=45.3°\pm0.10°$, with Cu radiation.

The Vickers hardness of the tape, in the part in contact with the wheel, measured with a Leitz microdurometer, Durimet model, is equal to 945 HV.

The tape proves to be bend-ductile, with a bend strain $\epsilon\approx1$, wherein $$\varepsilon = \frac{1}{(2R/s+1)},$$

with s=thickness of the tape and R=minimum bend radius.

Thermal treatment was effected on tape 1.a, under vacuum at different temperatures, between 750° C. and 880° C., and for different residence times t at the specific temperature and it was found that there is a value range (T,t) in which the bend-ductility is maintained, corresponding to a bend strain $\epsilon>0.1$. In the temperature range tested, the range of times t which satisfy the above condition for tape 1.a can be functionally identified as the pairs of values T(°C.) and t(minutes) which cause the inequality $$\ln t > A - B \cdot T \quad (1)$$

with parameter values A=28.1 and B=0.0275 (1/°C.).

Figure 2:
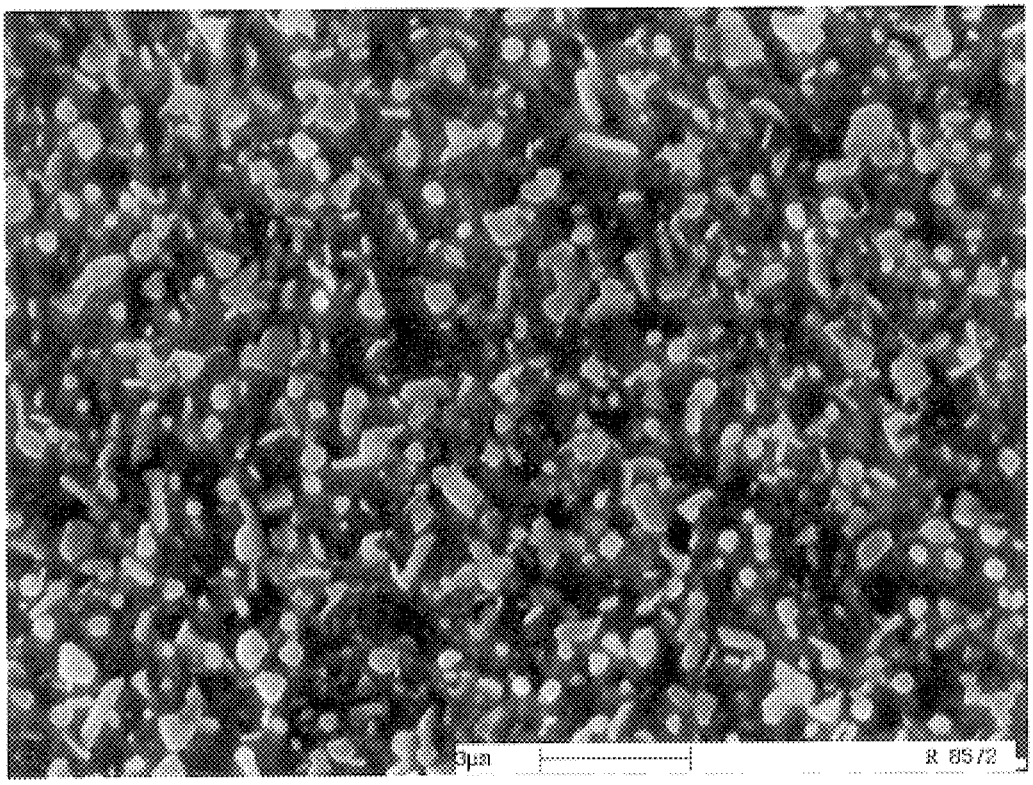
FIG. 2 is an electron scan micrograph for the tape of Example 1.

After tape 1.a has been subjected to thermal treatment under a vacuum of $10^{-5}$ mbars, at a temperature of 850° C., for a time of 120 minutes, (defined hereinafter as product 1.b), it has a microcrystalline structure, as can be observed from the micrograph obtained from the electronic scan microscope, illustrated in FIG. 2, with microcrystalline precipitates having average dimensions lower than or equal to 1 $\mu$m. The X-ray diffraction of the tape after thermal treatment, (sample 1.b) represented in FIG. 3, shows diffraction peaks typical of a face-centered cubic phase (FCC) and various peaks characteristic of $Ni_3B$ and CrB crystals.

Figure 3:
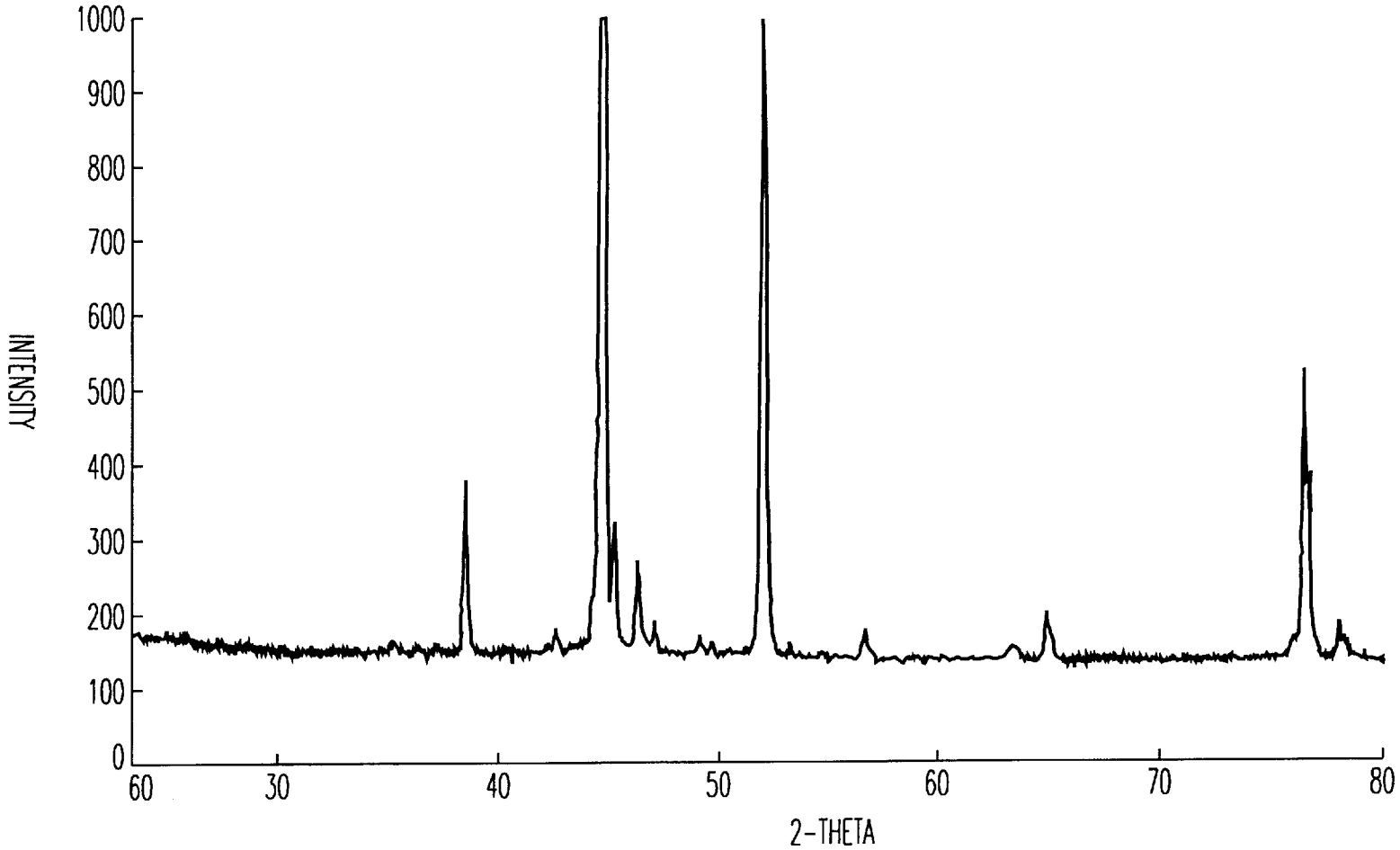
FIG. 3 is an x-ray diffraction graph for the tape of Example 1 after thermal treatment.

The interpretation of the most intense reflections of FIG. 3 is indicated in Table 1 below.

Figure 4:
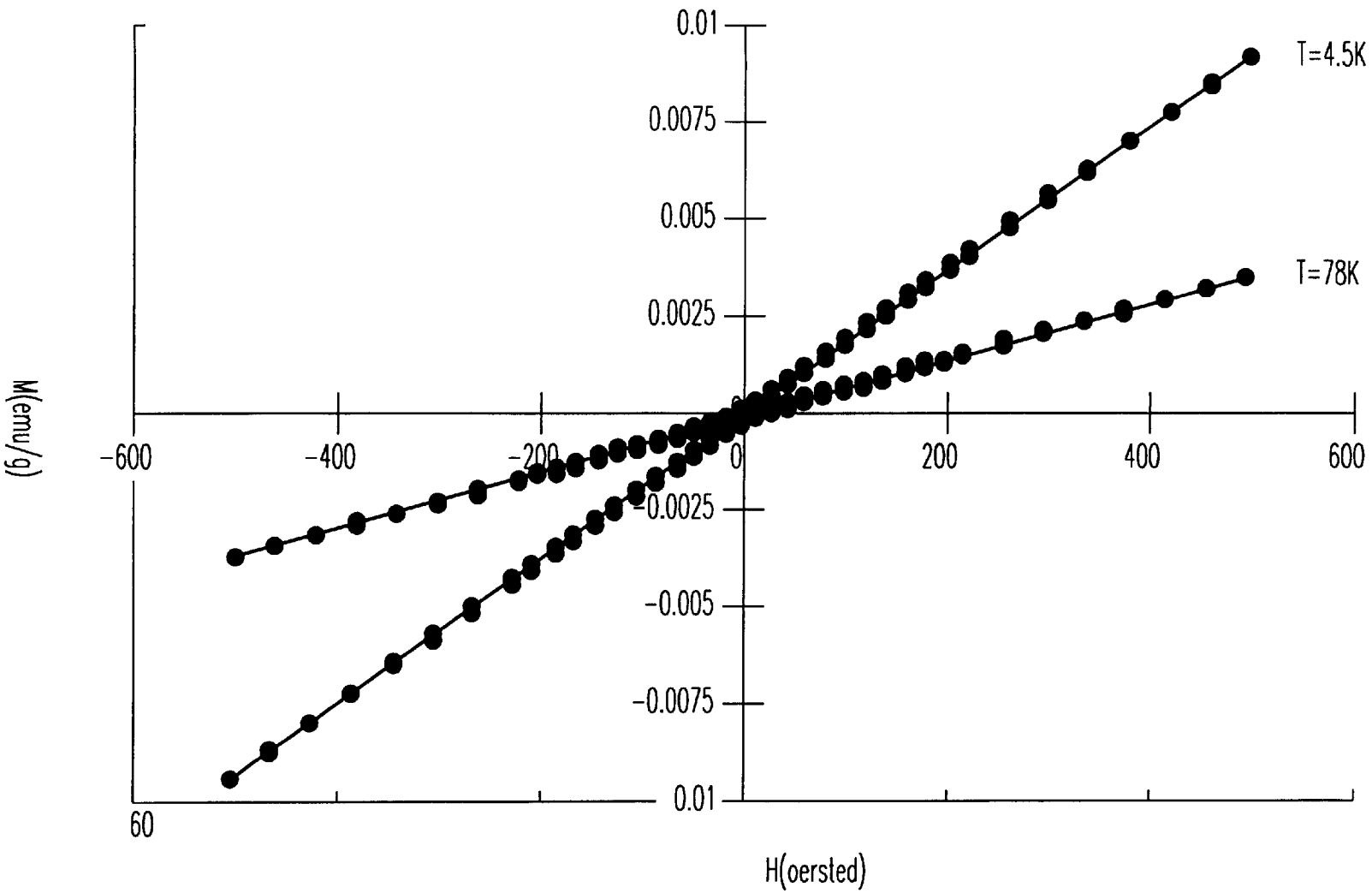
FIG. 4 shows magnetization curves for the tape of Example 1.

The Vickers micro-hardness of tape 1.b is equal to 450 HV;

the bend-ductility of tape 1.b is sufficiently high ($\epsilon=0.156$);

the electric resistivity of tape 1.b is equal to 96 $\mu\Omega$cm, at 23° C.;

the magnetization curves of tape 1.b, effected at 4.5 K and at 78 K, are indicated in FIG. 4; the residual specific magnetization with a field H=0, for both temperatures is <0.3 emu/kg.

Table 1

Identification of the diffraction reflexes according to the indexization of the component phases.

| Diffraction angle (2θ, $CuK_\alpha$) | Rel. Int. | FCC | $Ni_3B$ (JCPDS #17-335) | CrB (JCPDS #32-277) |
|---|---|---|---|---|
| 32.3 | 3 | | | (110) |
| 34.7 | 5 | | (020) | |
| 37.1 | 5 | | (021) | |
| 38.2 | 30 | | (112) | (021) |
| 42.4 | 5 | | (121) | |
| 44.5 | 100 | (111) | | |
| 44.7 | 50 | | (210) | |
| 45.1 | 30 | | | (111) |
| 46.0 | 20 | | (103) | (130) |
| 47.0 | 10 | | (211) | |
| 49.0 | 5 | | (122) | |
| 49.5 | 5 | | (113) | |
| 52.0 | 60 | (200) | | |
| 53.0 | 5 | | (212) | |
| 56.5 | 10 | | | (131) |
| 63.2 | 5 | | | (002) |
| 65.0 | 15 | — | — | — |
| 76.0 | 5 | | (232) | (151,221) |
| 76.6 | 40 | (220) | | |
| 78.0 | 10 | | (115,141) | |

The cubic structure phase FCC has a cell parameter $a_o$=0.3518 nm.

EXAMPLE 2

A tape prepared and treated as described in example 1 (product 1.b) was subsequently treated in air at 800° C. for 30 minutes.

The product obtained after this treatment has a greyish-green colour, with a shiny surface, it has maintained good hardness properties (400 HV) and has acquired a greater bend resistance (bend strain $\epsilon>0.15$), the weight percentage increase due to oxidation is limited, equal to about 0.16%, and the non-magnetization characteristics are the same as those of sample 1.b.

The surface of the sample was then abraded with diamond paste and the underlying part has a metallic gloss.

The average stoichiometry of Ni, Cr, Si was then tested in the product treated in air, by means of X-ray fluorescence microanalysis using an electronic scan microscope, by comparing the surface composition with that of a more internal part and comparing these compositions with that of the amorphous sample (1.a) and crystallized sample (1.b) of example 1. The results are indicated in Table 2 below.

Table 2

Ni, Cr, Si elemental composition, with the exclusion of the B atoms, resulting from the X-ray fluorescence analysis with an electronic microprobe.

| Sample | Ni at. % | Cr at. % | Si at. % |
|---|---|---|---|
| Nominal composition | 73.9 | 17.0 | 9.1 |
| Product 1.a amorph. (Ex. 1) | 72.2 | 17.0 | 10.8 |
| Product 1.b cryst. (Ex. 1) | 69.8 | 19.2 | 11.0 |
| Surface (Ex. 2) | 60.5 | 16.2 | 23.3 |
| Interior (Ex. 2) | 78.3 | 13.6 | 8.1 |

The substantial variations in composition of product 1.b annealed in air, between its surface and interior, indicate a migration of the silicon and chromium atoms, from the inside towards the surface of the product.

EXAMPLE 3

(comparative)

The amorphous tape obtained in Example 1 (product 1.a) was thermally treated at 800° C. for 30 minutes in air, and subsequently for a shorter time that what is indicated by the inequality (1) with parameters A and B of the composition of the alloy from which product 1.a derives. The product thus obtained is a bluish-coloured tape, extremely oxidized, very fragile, with a bend strain $\epsilon$=0.01.

EXAMPLE 4

32.16 g of electrolytic Ni having a purity>99.9%, 11.34 g of Cr having a purity>99.9%, 27.80 g of Si having a purity>99.9% were melted in a plasma oven in an atmosphere of helium. 14.60 g of B having a purity>99.9% was then added to the alloy which was melted and made homogeneous in an induction oven at 1300° C., under vacuum, obtaining the nominal composition of the alloy of 54.8 atom % of Ni, 21.8 atom % of Cr, 13.5 atom % of B and 9.9 atoms of Si.

Figure 5:
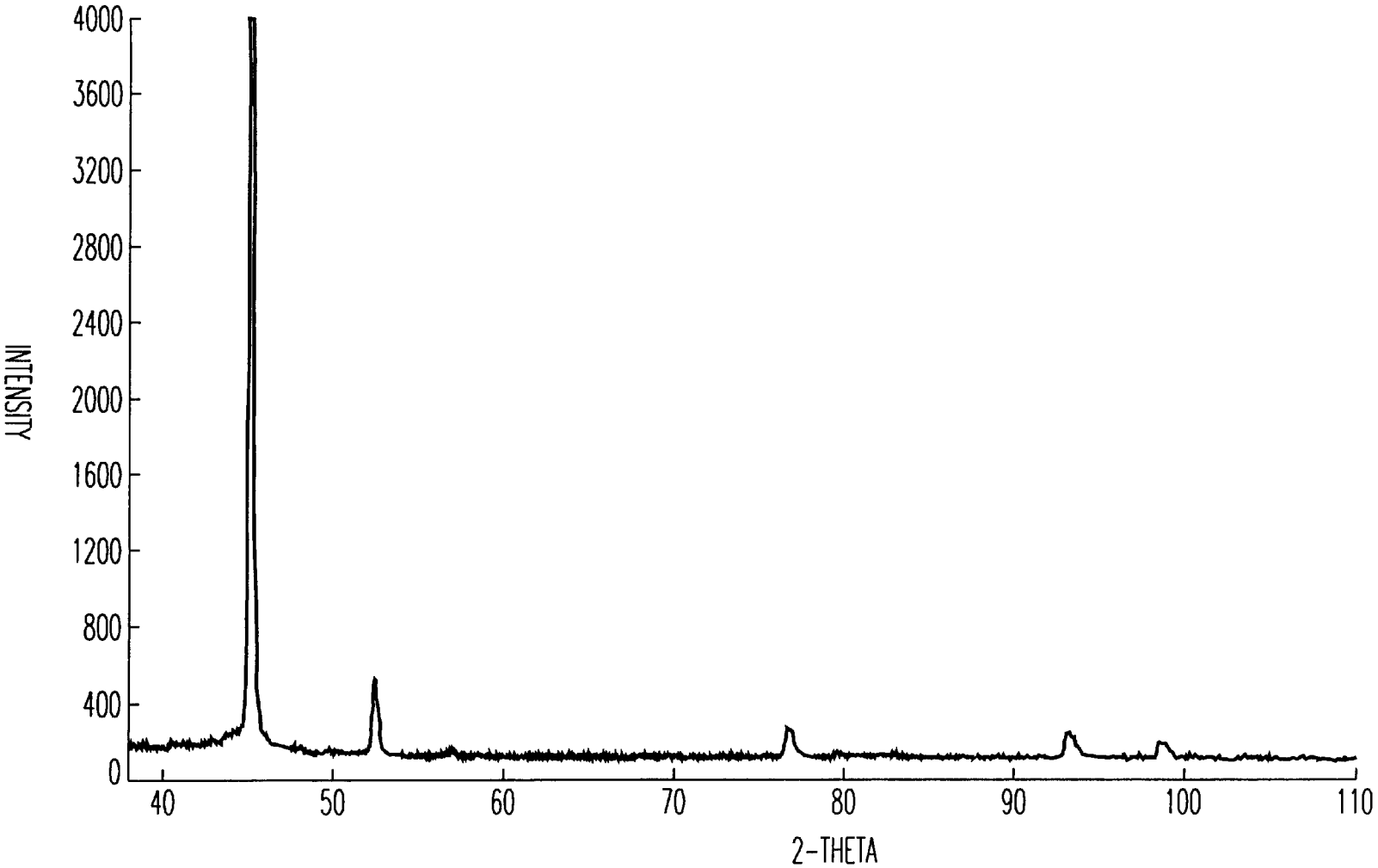
FIG. 5 is an x-ray diffraction graph for the tape of Example 4.

The alloy thus obtained was used to produce, as described in Example 1, a tape having a width of 8 mm and a thickness of 40$\mu$m (product 4.a). The tape has a non-planar, undulating form and is fragile on bending, with a bend strain $\epsilon$=0.01. From the X-ray diffraction, indicated in FIG. 5, it can be observed that it has a crystalline structure with a preponderance of FCC cubic structure phase.

The tape was then subjected, under vacuum at $10^{-5}$ mbars, to a thermal treatment at a temperature of 850° C., for a time of 120 minutes.

Figure 6:
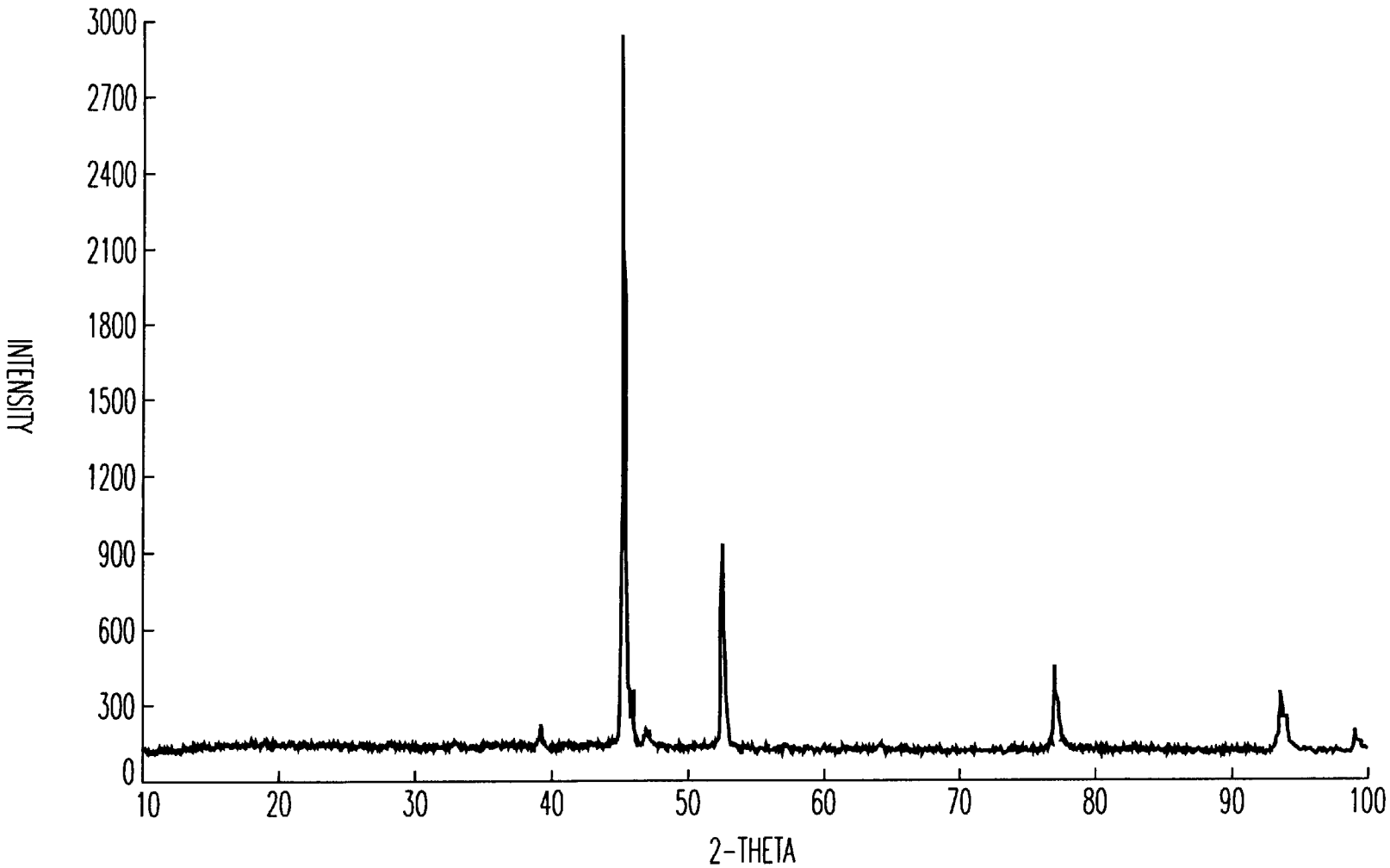
FIG. 6 is an x-ray diffraction graph for the tape of Example 4 after thermal treatment.

After this thermal treatment, the tape obtained (defined hereinafter as product 4.b) is less fragile on bending, with a bend strain $\epsilon$=0.07. The X-ray diffraction intensity profile of the tape after thermal treatment, represented in FIG. 6, also shows, in addition to the peaks of the FCC structure phase, the presence of diffraction peaks characteristic of the borides found in example 1.

The mechanical properties of product 4.b are as follows:

Vickers micro-hardness of the annealed tape is equal to 630 HV;

The magnetization curve shows, both at 4.5 K and at 78 K, a very low residual specific magnetization at H=0, less than 0.4 emu/kg.

What is claimed is:

1. An article based on a nickel-chromium-silicon metal alloy, including microcrystalline borides, obtained by rapid solidification, followed by thermal treatment at a temperature ranging from 700° C. to 950° C. for a time varying from 5 minutes for the upper temperature limit, to 100 hours for the lower temperature limit, of a nickel-chromium-boron-silicon metal alloy comprising from 39.0 to 69.4 atom % of nickel, from 11.8 to 33.9 atom % of chromium, from 7.6 to 27.4 atom % of boron and from 7.6 to 17.5 atom % of silicon.

2. The article according to claim 1, wherein the structure is a tape-form or filiform structure with a thickness lower than 50$\mu$m.

3. The article according to claim 2, wherein said thickness ranges from 5 to 40$\mu$m.

4. The article according to claim 1, wherein said thermal treatment is carried out at a temperature ranging from 750° C. to 880° C. for a time varying from about 30 minutes for the upper temperature limit to about 15 hours for the lower temperature limit.

5. The article according to claim 1, wherein said thermal treatment is carried out in an inert gas or under vacuum.

6. The article according to claim 5, wherein said thermal treatment is carried out at atmospheric pressure in an inert gas or under vacuum at a pressure lower than $10^{-4}$ mbars.

7. A method for the preparation of an article based on a nickel-chromium-silicon alloy, including microcrystalline borides, which comprises:

(1) preparing a nickel-chromium-boron-silicon metal alloy comprising from 39.0 to 69.4 atom % of nickel, from 11.8 to 33.9 atom % of chromium, from 7.6 to 27.4 atom % of boron and from 7.6 to 17.5 atom % of silicon by melting of the constituent elements, or their partial alloys, and subsequent cooling, in an inert atmosphere or under vacuum;

(2) transforming said alloy obtained into end-articles in the desired form of tape, film, sheet or fiber by rapid solidification;

(3) subjecting said article to a thermal treatment in an atmosphere of an inert gas or under vacuum at a temperature ranging from 700° C. to 950° C., for a time varying from 5 minutes for the upper temperature limit to 100 hours for the lower temperature limit.

8. The method according to claim 7, wherein said rapid solidification is carried out by melt spinning or planar flow casting.

9. A method of making a superconductor element comprising depositing superconductor oxides onto the article of claim 1 in the form of a tape or sheet.

10. A method of reinforcing comprising adding the article of claim 1 in the form of a tape, sheet or fiber to a composite having an organic, metallic or pyroceram matrix.

11. The method according to claim 10, wherein the temperature is lower than or equal to 900° C.

12. A metal alloy comprising a quaternary alloy of the following general formula:

$$Ni_xCr_yB_wSi_z$$

wherein x+y+w+z=100; x+y=65–84.8;

x/y=1.5–4.5; w/z>1; 7.6<w<27.4, wherein said alloy comprises from 39.0 to 69.4 atom % of nickel, from 11.8 to 33.9 atom % of chromium, from 7.6 to 27.4 atom % of boron and from 7.6 to 17.5 atom % of silicon.

* * * * *